US005999098A

United States Patent [19]

Lian et al.

[11] Patent Number: 5,999,098

[45] Date of Patent: Dec. 7, 1999

[54] REDISTRIBUTING MAGNETIC CHARGE IN BIAS ELEMENT FOR MAGNETOMECHANICAL EAS MARKER

[75] Inventors: Ming-Ren Lian, Boca Raton, Fla.; Kevin R. Coffey, Fremont, Calif.; David Lambeth, Pittsburgh, Pa.

[73] Assignee: Sensormatic Electronics Corporation, Boca Raton, Fla.

[21] Appl. No.: 09/018,108

[22] Filed: Feb. 3, 1998

[51] Int. Cl.[6] ..... G08B 13/14

[52] U.S. Cl. ..... 340/572.6; 340/572.1; 340/551

[58] Field of Search ..... 340/572.6, 572.1, 340/572.2, 572.3, 572.8, 551; 148/108

[56] References Cited

U.S. PATENT DOCUMENTS

| | | | |
|---|---|---|---|
| 4,510,489 | 4/1985 | Anderson, III et al. | 340/572 |
| 4,900,386 | 2/1990 | Richter-Jörgensen | 340/572.1 |
| 5,313,192 | 5/1994 | Ho et al. | 340/551 |
| 5,420,569 | 5/1995 | Dames et al. | 340/572 |
| 5,469,140 | 11/1995 | Liu et al. | 340/551 |
| 5,495,230 | 2/1996 | Lian | 340/551 |
| 5,565,849 | 10/1996 | Ho et al. | 340/572.6 |
| 5,568,125 | 10/1996 | Liu | 340/551 |
| 5,729,200 | 3/1998 | Copeland et al. | 340/572.6 |
| 5,767,770 | 6/1998 | Gadonniex | 340/572.6 |
| 5,825,290 | 10/1998 | Lian et al. | 340/572.6 |

*Primary Examiner*—Jeffery A. Hofsass
*Assistant Examiner*—John Tweel, Jr.
*Attorney, Agent, or Firm*—Robin, Blecker & Daley

[57] ABSTRACT

A bias element for use in a magnetomechanical EAS marker is magnetized to saturation. Then the magnetic charge in the bias element is redistributed by applying to the bias element a magnetic field having an AC ringdown characteristic. The redistribution of magnetic charge improves the stability of the bias element, so that the marker incorporating the bias element is less likely to have its resonant frequency shifted by exposure to a stray magnetic field.

54 Claims, 4 Drawing Sheets

REDISTRIBUTING MAGNETIC CHARGE IN BIAS ELEMENT FOR MAGNETOMECHANICAL EAS MARKER

FIELD OF THE INVENTION

This invention relates to magnetomechanical markers used in electronic article surveillance (EAS) systems and is more particularly concerned with a method of activating bias elements to be used in such markers.

BACKGROUND OF THE INVENTION

It is well known to provide electronic article surveillance systems to prevent or deter theft of merchandise from retail establishments. In a typical system, markers designed to interact with an electromagnetic field placed at the store exit are secured to articles of merchandise. If a marker is brought into the field or "interrogation zone", the presence of the marker is detected and an alarm is generated. Some markers of this type are intended to be removed at the checkout counter upon payment for the merchandise. Other types of marker remain attached to the merchandise but are deactivated upon checkout by a deactivation device which changes a magnetic characteristic of the marker so that the marker will no longer be detectable at the interrogation zone.

One type of EAS system employs magnetomechanical markers that include a magnetostrictive element. U.S. Pat. No. 4,510,489, issued to Anderson et al., discloses a marker formed of a ribbon-shaped length of a magnetostrictive amorphous material contained in an elongated housing in proximity to a biasing magnetic element. The magnetostrictive element is fabricated such that it is resonant at a predetermined frequency when the bias element has been magnetized to a certain level. At the interrogation zone, a suitable oscillator provides an AC magnetic field at the predetermined frequency, and the marker mechanically resonates at this frequency upon exposure to the field when the bias element has been magnetized to a certain level. The interrogation field is provided in pulses or bursts. A marker present in the interrogation field is excited by each burst, and after each burst is over, the marker undergoes a damped mechanical oscillation. The resulting signal radiated by the marker is detected by detecting circuitry which is synchronized with the interrogation circuit and arranged to be active during the quiet periods after bursts. EAS systems of the above-described pulsed-field magnetomechanical type are sold by the assignee of this application under the brand name "Ultra*Max" and are in widespread use. (The disclosure of the Anderson et al. patent is incorporated herein by reference.)

In magnetomechanical markers of the type described above, the bias element may be utilized as a control element to switch the marker between activated and deactivated states. Typically, the bias element is formed of a semi-hard magnetic material, such as the material designated as "Semi-Vac 90", which is available from Vacuumschmelze, Hanau, Germany. Conventional bias elements are in the form of a ribbon-shaped length of the semi-hard material. To place the marker in the activated condition, the bias element is magnetized substantially to saturation with the polarity of magnetization parallel to the length extent of the bias element. To deactivate the marker, the magnetic state of the bias element is substantially changed, as, for example, by degaussing the bias element by applying thereto an AC magnetic field at a level higher than the coercivity $H_c$ of the material. When the bias element has been degaussed, it no longer provides the bias field required to cause the magnetostrictive element (also known as the "active element") to oscillate at the predetermined operating frequency of the EAS system. In addition, the level of the signal output by the magnetostrictive element is greatly reduced in the absence of the bias field. Consequently, when the bias element has been degaussed, the magnetostrictive element does not respond to the interrogation signal so as to produce a signal that can be detected by the detection circuitry of the EAS system.

Co-pending patent application Ser. No. 08/697,629, filed Aug. 28, 1996 (which has a common assignee and a common inventor with the present application), discloses an improved magnetomechanical EAS marker in which the bias element is formed of a semi-hard magnetic material which has a lower coercivity than conventional materials for bias elements. When such low-coercivity bias elements are used, it is possible to deactivate markers by applying a much lower level AC field than was required with conventional, higher-coercivity bias elements. This, in turn, allows for a reduction in the power level at which deactivation equipment is operated. Also, or alternatively, the markers can be reliably deactivated at a greater distance from the deactivation device than was feasible with higher-coercivity bias elements. Moreover, with the lower power level required for deactivation of the low-coercivity bias elements, it becomes feasible to operate deactivation equipment in a continuous wave mode, rather than in triggered pulses as has been the practice in conventional deactivation equipment.

For the reasons given above, it is desirable that magnetomechanical EAS markers be deactivatable with a rather low level AC field. However, it is a competing desirable characteristic of EAS markers that the same be "stable". That is, when a marker is in an activated condition, its response characteristics should not be adversely affected by exposure to stray magnetic fields that may be encountered during shipment, handling or storage of the marker. It will be understood that if the coercivity of the bias element is too low, the risk of unintentional deactivation by exposure to stray fields may become excessive.

The inevitable trade-off between stability and low deactivation field level can be ameliorated if the bias element exhibits "abruptness". That is, it is desirable that the bias element exhibit stability over a range of applied AC fields from zero up to a threshold level, and that the bias element exhibit a rather sharp or abrupt decrease in magnetization in response to exposure to an AC field having a peak amplitude above the threshold level.

OBJECTS AND SUMMARY OF THE INVENTION

It is accordingly an object of the invention to provide a bias element for a magnetomechanical EAS marker exhibiting greater abruptness than prior art bias elements.

It is another object of the invention to provide a bias element for a magnetomechanical marker exhibiting stability in regard to exposure to low level stray magnetic fields.

It is a further object of the invention to provide a method of processing bias elements for magnetomechanical EAS markers so as to reduce magnetic clamping effects in the markers.

It is still another object of the invention to process bias elements for EAS markers in a manner which sets the resonant frequency of the EAS marker.

According to an aspect of the invention, there is provided a method of magnetizing a bias element for use in a magnetomechanical EAS marker, in which the method includes the steps of applying a magnetic field to the bias element to magnetize the bias element substantially to saturation, and then processing the substantially saturated bias element to redistribute a locus of magnetic charge in the element, the processing being applied so that the bias element retains a substantial remanent magnetization along its length extent. A preferred process for redistributing the magnetic charge in the saturated bias element includes applying to the saturated bias element a magnetic field having an AC ringdown characteristic. Assuming that the bias element has a coercivity $H_c$, the maximum amplitude of the AC ringdown magnetic field is preferably substantially less than $H_c$. Alternatively, or in addition, the process for redistributing the magnetic charge in the saturated bias element may include heating the saturated bias element to a temperature below the material's Curie temperature, and/or mechanically stressing the bias element to accomplish the desired redistribution of magnetic charge, and/or applying to the bias element a DC magnetic field pulse of polarity opposite to the polarity of magnetization of the bias element. When the AC ringdown field is employed to redistribute the magnetic charge, both the saturation of the bias element and the redistribution of magnetic charge in the bias element are preferably performed after the marker has been assembled.

According to another aspect of the invention, there is provided a method of making a marker for use in a magnetomechanical electronic article surveillance system, the method including the steps of providing an amorphous magnetostrictive element, providing a semi-hard magnetic bias element, magnetizing the bias element substantially to saturation, redistributing a locus of magnetic charge in the saturated bias element, and mounting the bias element adjacent the magnetostrictive element. The step of mounting the bias element adjacent to the magnetostrictive element may be performed before or after either one of the magnetizing and redistributing steps.

By processing the saturated bias element to redistribute the magnetic charge of the saturated bias element, the "abruptness" of the bias element is enhanced. Specifically, the bias element exhibits improved stability in respect to exposure to stray fields at a level below the amplitude of an AC field used to redistribute the charge. Further, exposure of the bias element to fields greater than the redistribution field amplitude results in a steeper resonant frequency shift characteristic as compared to markers which employ saturated bias elements. Thus the level of the AC field used for redistribution of the magnetic charge serves to set a "threshold", below which the bias element is stable, and above which it is subject to rather abrupt demagnetization.

Also, the redistribution of the magnetic charge reduces magnetic clamping effects that might otherwise be applied by the bias element to the active element, so that the performance of the marker is improved. In addition, the resonant frequency of the marker may be fine-tuned by the application of the AC field to redistribute the magnetic charge.

The foregoing and other objects, features and advantages of the invention will be further understood from the following detailed description of preferred embodiments and practices thereof and from the drawings, wherein like reference numerals identify like components and parts throughout.

DESCRIPTION OF PREFERRED EMBODIMENTS AND PRACTICES

Figure 1:
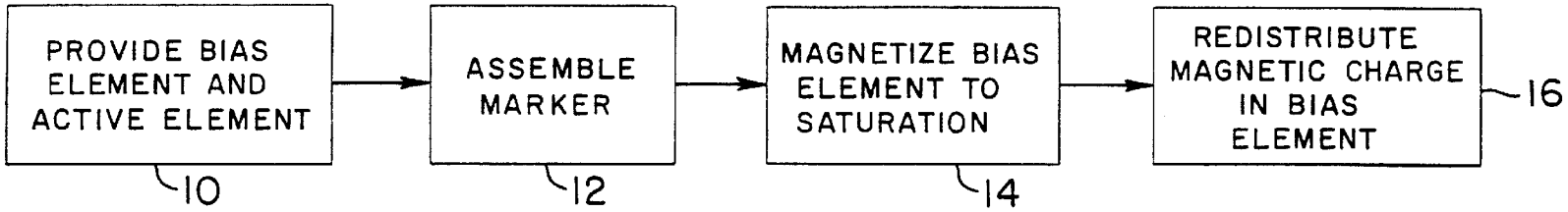
FIG. 1 is a flow diagram illustrating a process carried out in accordance with the invention to provide a magnetomechanical EAS marker in an activated condition.

A method of fabricating a magnetomechanical EAS marker in accordance with the invention will now be described, initially with reference to FIG. 1. FIG. 1 illustrates in flow diagram form the method of the present invention. In a first step, represented by block 10, a bias element and an active (magnetostrictive) element are provided. The bias element may be any known bias element used or suitable for use in magnetomechanical markers. According to preferred embodiments of the invention, the bias element is a discrete, rectangular length of alloy ribbon-formed of a low-coercivity semi-hard alloy such as those described in the above-referenced '629 patent application. (A "semi-hard magnetic material" should be understood to mean a material having a coercivity in the range of about 10 to 500 Oe.) For example, the bias element may be formed of an alloy designated as "MagnaDur 20-4" which has a coercivity of about 20 Oe and is commercially available from Carpenter Technology, Reading, Pa. The composition of MagnaDur 20-4 is substantially $Fe_{77.5}Ni_{19.3}Cr_{0.2}Mn_{0.3}Mo_{2.4}Si_{0.3}$ (atomic percent). Another suitable material is the alloy designated as Vacozet, commercially available from Vacuumschmelze GmbH, Gruner Weg 37, D-63450, Hanau, Germany. The Vacozet material has a coercivity of 22.7 Oe and a composition of substantially $Co_{55.4}Fe_{29.9}Ni_{11.1}Ti_{3.6}$ (atomic percent).

According to another alternative, an alloy designated as Metglas 2605SB1, commercially available from AlliedSignal Inc., Parsippany, N.J., may be used. The SB1 material, as cast, is magnetically soft, but may be processed so as to become semi-hard. (Processing of a magnetically soft material to form a semi-hard bias element is disclosed in U.S. Pat. No. 5,351,033.) The SB1 material has a composition of substantially $Fe_{80.2}Co_{0.2}B_{13.7}Si_{5.8}Mn_{0.1}$ (atomic percent) and is processed as follows to raise its coercivity to about 19 Oe.

Cut strips of the SB1 material are placed in a furnace at room temperature and a substantially pure nitrogen atmosphere is applied. The material is heated to about 485° C. and the latter temperature is maintained for one hour to prevent dimensional deformation that might otherwise result from subsequent treatment. Next, the temperature is increased to about 585° C. After an hour at this temperature, ambient air is allowed to enter the furnace to cause oxidation of the material. After one hour of oxidation at 585° C., nitrogen gas is again introduced into the furnace to expel the ambient air and end the oxidation stage. Treatment for another hour at 580° C. and in pure nitrogen then occurs. At that point, the temperature is raised to 710° C. and treatment in pure nitrogen continues for one hour, after which the furnace is allowed to cool to room temperature. Only after cooling is completed is exposure to air again permitted.

The active element may be of any known type, including, for example, as-cast Metglas 2826 MB (which has a composition $Fe_{40}Ni_{38}Mo_4B_{18}$) or any of the cross-field annealed active elements having a linear hysteresis loop, as disclosed in U.S. Pat. Nos. 5,469,140 and 5,568,125(commonly assigned with the present application), or any other suitable material.

According to block 12 (FIG. 1), the bias element is assembled with the magnetostrictive element to form a magnetomechanical marker. This may be done in accordance with conventional practice using a known housing structure. Then, as indicated by block 14, the bias element is magnetized to saturation. This may be accomplished by any conventional technique that results in a remanent magnetization at or substantially at saturation, but the process should be performed so that the polarity of magnetization is parallel to the length extent of the bias element. Next, as indicated by block 16, another magnetic field is applied to the saturated bias element to redistribute the magnetic charge within the bias element.

The second magnetic field should have an AC ringdown characteristic. For many materials a suitable AC ringdown field has a peak amplitude at the beginning of application of the field at about 30 to 85% of the coercivity $H_c$ of the bias element. Preferably the AC ringdown waveform has a zero DC offset, although a non-zero offset may also be used. The frequency of the AC field is not critical, but may be around 100 Hz. The ringdown may be linear or exponential or otherwise decaying, and may have a duration of about 10 to 20 cycles.

Figure 6:
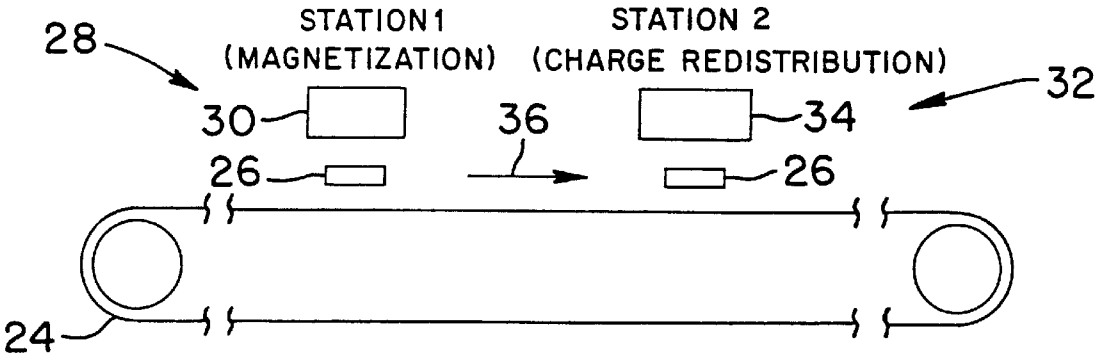
FIG. 6 is a schematic illustration of a portion of an apparatus for performing the process of FIG. 1.

FIG. 6 schematically illustrates an assembly line operation by which the process of FIG. 1 may be carried out (although steps 10 and 12 are omitted from FIG. 6). The assembly line of FIG. 6 includes a conveyor 24 for transporting markers 26 from process station to process station. FIG. 6 shows only two of a number of process stations that may be included in the assembly line. The two stations shown in FIG. 6 include: (1) a magnetization station 28 at which a magnetizing means 30 (which may be a permanent magnet) magnetizes to saturation the bias element (not separately shown) of marker 26 to carry out step 14 of FIG. 1; and (2) a magnetic charge redistribution station 32 at which a "knockdown" device 34 generates a suitable AC ringdown magnetic field to carry out step 16 of FIG. 1. The conveyor 24 operates to transport markers 26 in the direction indicated by arrow 36, i.e., from the magnetizing station 28 to the charge redistribution station 32.

Figure 2:
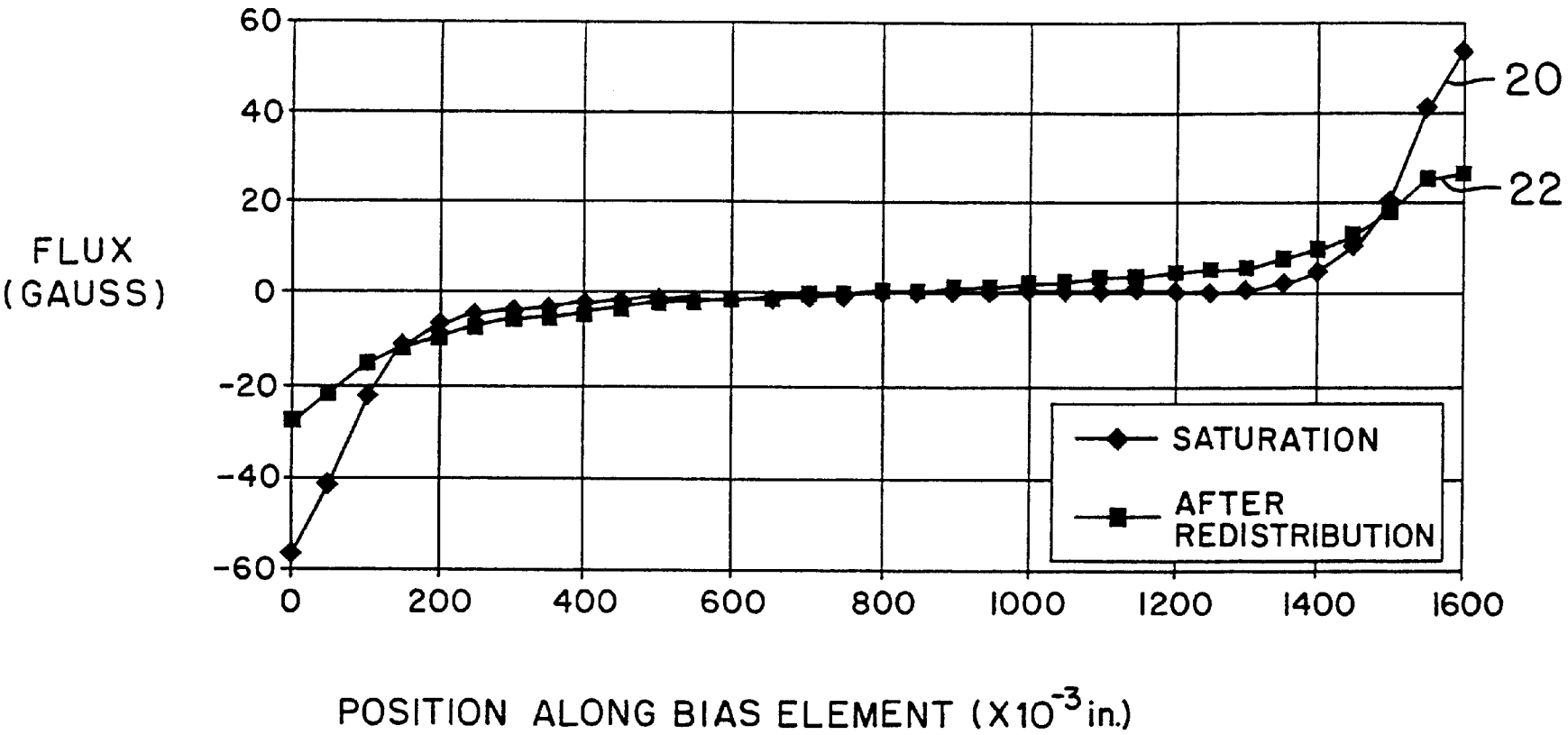
FIG. 2 graphically illustrates a magnetic charge distribution along the length of the bias element before and after a charge redistribution step carried out in accordance with the invention.

FIG. 2 graphically illustrates the effect of application of the AC ringdown field to a saturated bias element. The data graphed in FIG. 2 were obtained with respect to a 1.6 inch long strip of the SemiVac 90 material, which has a coercivity of about 80 Oe. Curve 20 in FIG. 2, which links diamond-shaped data points, illustrates the magnetic charge distribution along the length of the bias element after saturation (step 12) and prior to magnetic charge redistribution (step 14). Specifically, the data represents flux measurements taken at various positions along the length of the bias element, with the value 0 in the horizontal scale corresponding to one end of the element and the value 1600 corresponding to the other end of the element. Curve 20 illustrates that upon saturation the magnetic charge is strongly concentrated at the ends of the bias element.

Curve 22, which joins square-shaped data points, represents the distribution of magnetic charge after application of the AC ringdown field to the saturated bias element. The initial peak value of the AC ringdown field was about 63 Oe. It will be seen that the AC ringdown field served to redistribute a substantial amount of the magnetic charge from the ends of the bias element towards the center of the element.

Figure 3:
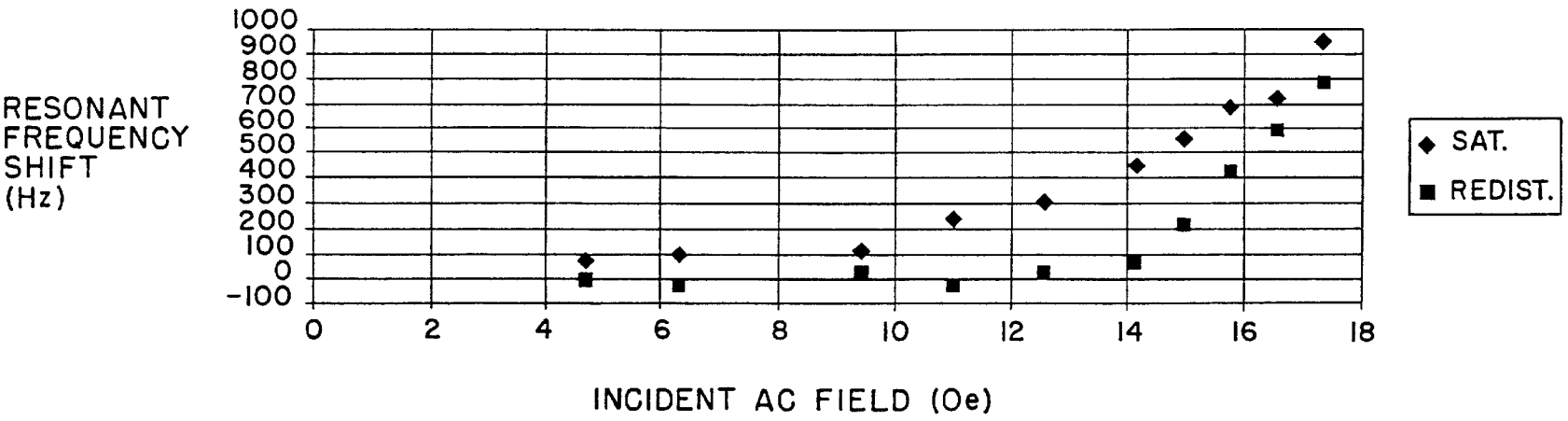
FIG. 3 shows curves representing changes in marker resonant frequency according to levels of incident AC field, to illustrate respective "abruptness" characteristics of the bias element before and after the magnetic charge redistribution step.

FIG. 3 graphically illustrates how redistributing the magnetic charge enhances both the stability and the abruptness of the resulting marker. The data graphed in FIG. 3 was obtained with respect to a marker including a bias element formed of the SB1 material processed to have a coercivity of about 19 Oe. The horizontal scale in FIG. 3 represents a level of AC field applied to the marker to represent a stray field and the vertical scale indicates to what extent the application of the AC field caused a shift in the resonant frequency of the marker. The diamond-shaped data points indicate results obtained when the bias element was saturated but the magnetic charge redistribution step was not performed; the square data points indicate results obtained after a magnetic charge redistribution was performed by applying to the saturated bias element an AC ringdown field with an initial peak amplitude of about 14 Oe. Comparing the sequence of diamond shaped data points (saturated bias element) versus the sequence of square data points (redistributed-charge bias element), it will be observed that the marker having the bias element treated with the redistribution field exhibits greater frequency stability when the disturbance field is no more than about 14 Oe, i.e., about the peak level of the redistribution field. Thereafter, for increasing levels of the disturbance field, a steeper slope, corresponding to greater abruptness, is exhibited by the marker having the bias element in which the magnetic charge was redistributed.

It is believed that treating the saturated bias element with an AC ringdown field having a peak amplitude below the coercivity of the bias material causes a partial relaxation of the magnetization of the bias element. Subsequent exposure of the treated bias element to stray fields at a level below the peak of the AC ringdown field has little or no effect on the degree of magnetization of the bias element. Consequently, the resulting magnetomechanical marker exhibits stability in its resonant frequency in respect to exposure to stray fields below the level of the treatment field, and a rather abrupt shift in resonant frequency if a higher level AC field is applied to deactivate the marker. The initial level of the ringdown serves to set the threshold between the stable region and the abrupt frequency shift region of the resonant frequency characteristic exemplified by the square data points in FIG. 3.

Figure 4:
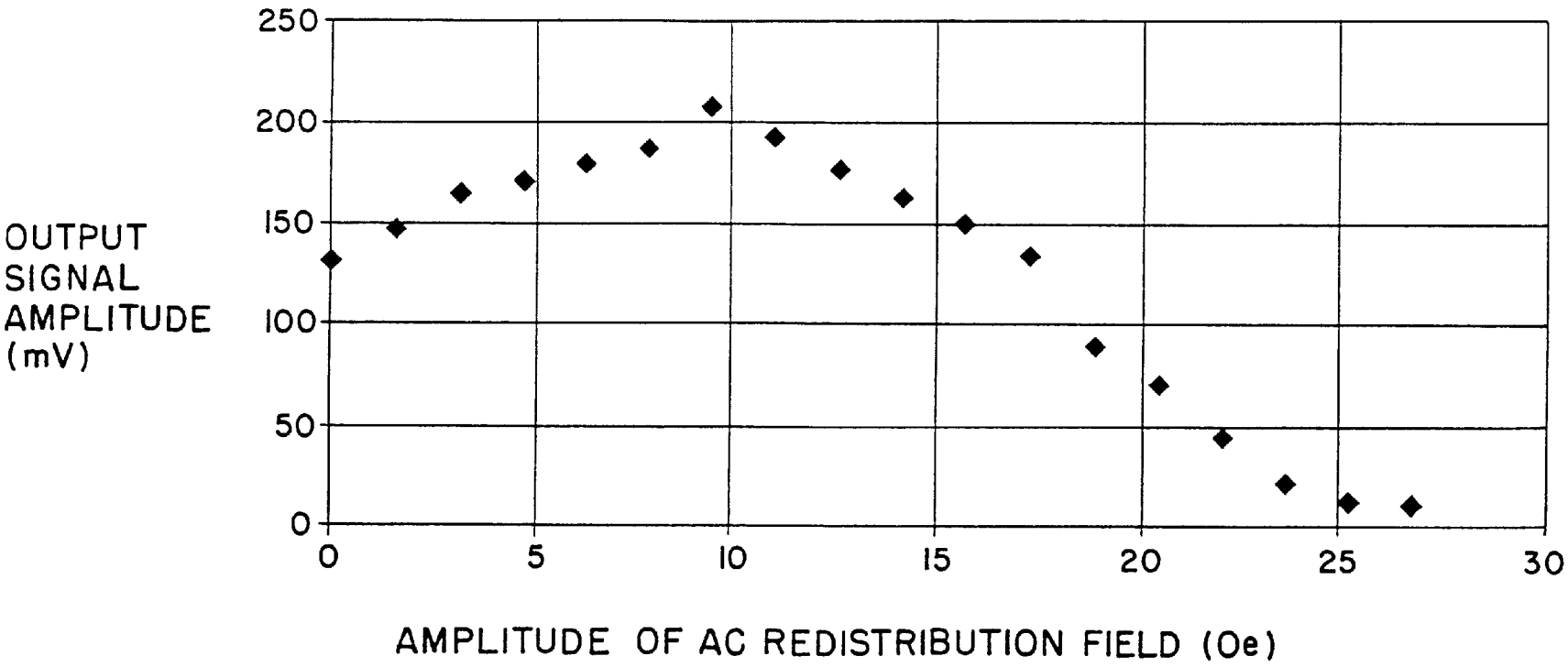
FIG. 4 is a graph showing changes in output signal amplitude of the marker according to variations in the strength of the AC field applied in the redistribution step.

FIG. 4 graphically illustrates how the level of the AC ringdown field used to redistribute the magnetic charge affects the output signal level of the resulting marker. The results shown in FIG. 4 were obtained with a marker which has a bias element formed of the same processed SB1 material referred to above. The horizontal scale in FIG. 4 indicates the initial peak level of the AC ringdown field used to redistribute the magnetic charge, and the vertical scale indicates the so-called A1 level of the resulting marker, which is the level of the signal output by the active element as measured one millisecond after the end of the excitation field pulse. It will be observed that the redistribution treatment tends to increasingly enhance the output signal level for initial peak amplitudes of the AC ringdown field in a range of up to about 10 Oe. Thereafter, the output signal amplitude declines with increases in the initial peak level of the AC ringdown field.

It is believed that, in the range below 10 Oe of the AC ringdown field, the redistribution of the magnetic charge serves to reduce magnetic clamping of the active element to the bias element. At levels of the AC ringdown field above 10 Oe, the improvement in performance due to reduction of clamping is progressively outweighed by a reduction in the effective bias field provided by the bias element.

Taking FIGS. 3 and 4 together, it is to be understood that for higher levels of the AC ringdown field, there is a trade-off between stability and output signal amplitude. Although increasing the level of the AC ringdown field widens the range of stability for the marker, application of an AC ringdown redistribution field above a certain level tends to reduce the output signal amplitude of the marker. It is believed that, for many materials, the most satisfactory results are obtained with an initial peak level of the AC ringdown redistribution field at about 50 to 70% of the coercivity $H_c$ of the bias element.

Figure 5:
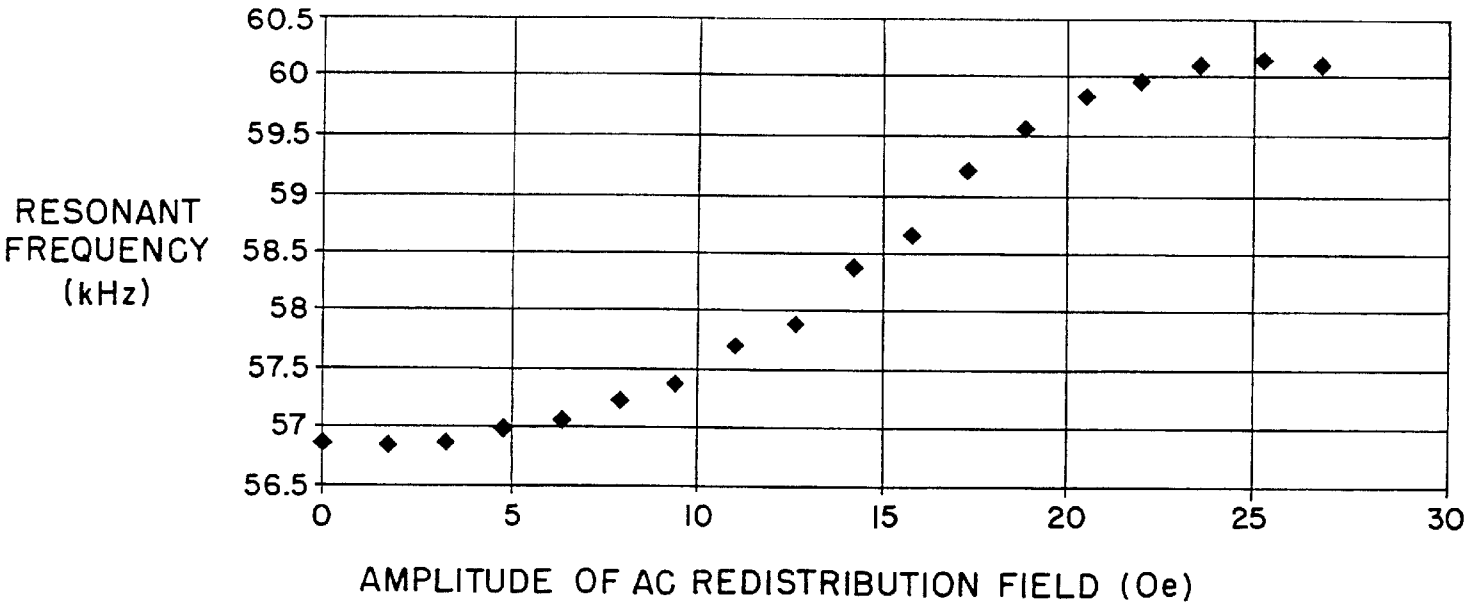
FIG. 5 is a graph showing changes in the resonant frequency of the marker according to variations in the strength of the AC field applied in the redistribution step.

FIG. 5 graphically illustrates how variation of the initial level of the AC ringdown field used for redistributing the magnetic charge of the bias element affects the resonant frequency of the resulting marker. FIG. 5 shows results obtained using the same processed SB1 bias element as in FIGS. 3 and 4. As in FIG. 4, the horizontal scale represents the initial peak level of the AC ringdown field, whereas the vertical scale in FIG. 5 represents the resonant frequency of the marker. It will be observed that the resonant frequency trends upward as the peak level of the AC ringdown field increases. Accordingly, the level of the AC ringdown field can be employed to fine-tune the resonant frequency of the marker.

The procedure illustrated in FIG. 1 may be changed in some respects. For example, the step of assembling the marker may occur after the bias element is magnetized and either before or after the magnetic charge in the bias element is redistributed. However, because it may be difficult to handle the magnetized bias element, it is preferred to assemble that marker before magnetizing the bias element.

When the magnetization and charge redistribution steps are applied to an assembled marker, and the charge redistribution is performed by applying an AC ringdown magnetic field, the magnetically soft active element tends to shield or divert part of the applied field from the bias element so that the field level actually experienced by the bias element is lower than the applied field level immediately around the marker. The preferred peak field levels for the AC ringdown signal as disclosed and claimed herein refer to the level as actually experienced by the bias element.

Also, as noted before, as an alternative to applying the AC ringdown field to redistribute the magnetic charge in the saturated bias element, the saturated bias element may be mechanically stressed and/or heated to a temperature below the Curie temperature of the bias element. Depending on the nature of the marker housing, it may not be feasible to apply heat or stress to the bias element after assembling the marker, in which case the magnetizing and charge-redistribution steps should be performed prior to the marker-assembly step.

As another alternative, and assuming the polarity of the magnetization of the bias element is known or detected, the magnetic charge distribution can be accomplished by applying to the saturated bias element one or more pulses of DC magnetic field at a polarity opposite to the polarity of magnetization of the saturated bias element. A suitable peak level for the DC magnetic field pulse would be in the range of 30% to 85% of $H_c$, which, as before, is the coercivity of the bias element.

The inventive process disclosed herein, in which a bias element is magnetized to saturation, and then the magnetic charge in the element is redistributed, is beneficial in that:

(a) The stability and abruptness of the magnetomechanical marker are enhanced, which allows for a more satisfactory compromise between the competing goals of ease in deactivation and stability upon exposure to stray magnetic fields.

(b) The output signal amplitude of the marker is enhanced by reducing or eliminating magnetic clamping between the bias element and the active element. This reduces or eliminates the need to employ such prior art anti-clamping techniques as providing the bias element in a parallelogram shape, or imparting a longitudinal or transverse curvature to the bias element. Consequently, a low profile marker housing, as disclosed in U.S. Pat. No. 5,469,140, may be used without substantial risk that the performance of the marker may be harmed by magnetic clamping.

(c) The magnetic charge redistribution step may be employed to fine-tune the resonant frequency of the marker to match the operating frequency of the marker detection equipment. This charge redistribution technique is an alternative to the prior art marker tuning process disclosed in U.S. Pat. No. 5,495,230. In the process of the '230 patent, the bias element is not magnetized to saturation. Rather, an AC ringdown field with a substantial DC offset, and an initial peak level substantially above the coercivity of the bias element, was employed to magnetize the bias element to a predetermined level of magnetization substantially below saturation.

Various changes in the practices described above may be introduced without departing from the invention. The particularly preferred embodiments of the invention are thus intended in an illustrative and not limiting sense. The true spirit and scope of the invention is set forth in the following claims.

What is claimed is:

1. A method of magnetizing a bias element for use in a magnetomechanical EAS marker, said bias element having a length extent, the method comprising the steps of:

applying a magnetic field to said bias element to magnetize said element substantially to saturation; and processing said substantially saturated bias element to redistribute a locus of magnetic charge in said element, said processed bias element retaining a substantial remanent magnetization along its length extent.

2. A method according to claim 1, wherein said processing step includes applying to said substantially saturated bias element a magnetic field having an AC ringdown characteristic.

3. A method according to claim 2, wherein said bias element has a coercivity $H_c$ and said magnetic field having an AC ringdown characteristic has a maximum amplitude that is substantially less than $H_c$.

4. A method according to claim 3, wherein said magnetic field having an AC ringdown characteristic has a maximum amplitude that is in the range of 30% to 85% of $H_c$.

5. A method according to claim 4, wherein said coercivity Hc of said bias element is substantially 20 Oe and said magnetic field having an AC ringdown characteristic has a maximum amplitude that is in the range of 10 Oe to 14 Oe.

6. A method according to claim 2, wherein said magnetic field having an AC ringdown characteristic has substantially no DC offset.

7. A method according to claim 1, wherein said processing step includes applying to said substantially saturated bias element a DC magnetic field pulse, said pulse having a polarity that is opposed to a polarity of magnetization of said substantially saturated bias element.

8. A method according to claim 7, wherein said bias element has a coercivity $H_c$, said pulse having a maximum amplitude that is substantially less than $H_c$.

9. A method according to claim 8, wherein said maximum amplitude of said pulse is in the range of 30% to 85% of $H_c$.

10. A method according to claim 1, wherein said processing step includes heating said substantially saturated bias element to a temperature below a Curie temperature of said bias element.

11. A method according to claim 1, wherein said processing step includes applying mechanical stress to said substantially saturated bias element.

12. A method according to claim 1, further comprising the step of transporting said bias element from a first location at which said applying step occurs to a second location at which said processing step occurs.

13. A method of making a marker for use in a magnetomechanical electronic article surveillance system, the method comprising the steps of:

providing an amorphous magnetostrictive element;

providing a semi-hard magnetic bias element;

magnetizing said bias element substantially to saturation;

processing said saturated bias element to redistribute a locus of magnetic charge in said saturated bias element; and mounting said bias element adjacent said magnetostrictive element.

14. A method according to claim 13, wherein said mounting step is performed after at least one of said magnetizing and processing steps.

15. A method according to claim 13, wherein said mounting step is performed before at least one of said magnetizing and processing steps.

16. A method according to claim 13, wherein said processing step includes applying to said substantially saturated bias element a magnetic field having an AC ringdown characteristic.

17. A method according to claim 13, wherein said bias element has a coercivity $H_c$ and said magnetic field having said AC ringdown characteristic has a maximum amplitude that is substantially less than $H_c$.

18. A method according to claim 17, wherein said magnetic field having an AC ringdown characteristic has a maximum amplitude that is in the range of 30% to 85% of $H_c$.

19. A method according to claim 18, wherein said coercivity $H_c$ of said bias element is substantially 20 Oe and said maximum amplitude of said magnetic field is in the range of 10 Oe to 14 Oe.

20. A method according to claim 16, wherein said magnetic field having said AC ringdown characteristic has substantially no DC offset.

21. A method according to claim 13, wherein said processing step includes applying to said substantially saturated bias element a DC magnetic field pulse, said pulse having a polarity that is opposed to a polarity of magnetization of said substantially saturated bias element.

22. A method according to claim 21, wherein said bias element has a coercivity $H_c$, said pulse having a maximum amplitude that is substantially less than $H_c$.

23. A method according to claim 22, wherein said maximum amplitude of said pulse is in the range of 30% to 85%-of $H_c$.

24. A method according to claim 13, wherein said processing step includes heating said substantially saturated bias element to a temperature below a Curie temperature of said bias element.

25. A method according to claim 13, wherein said processing step includes applying mechanical stress to said substantially saturated bias element.

26. A method according to claim 13, further comprising the step of transporting said bias element from a first location at which said magnetizing step occurs to a second location at which said processing step occurs.

27. A method of conditioning a bias element so that said bias element provides a bias field for a magnetomechanical EAS marker, said bias element having a length extent, the method comprising the steps of:

applying a magnetic field to said bias element to magnetize said element substantially to saturation; and processing said substantially saturated bias element to redistribute a locus of magnetic charge in said element, said processed bias element retaining a substantial remanent magnetization along its length extent.

28. A method according to claim 27, wherein said processing step includes applying to said saturated bias element a magnetic field having an AC ringdown characteristic.

29. A method according to claim 28, wherein said bias element has a coercivity $H_c$ and said magnetic field having said AC ringdown characteristic has a maximum amplitude that is substantially less than $H_c$.

30. A method according to claim 29, wherein said magnetic field having an AC ringdown characteristic has a maximum amplitude that is in the range of 30% to 85% of $H_c$.

31. A method according to claim 30, wherein said coercivity $H_c$ of said bias element is substantially 20 Oe and said magnetic field having said AC ringdown characteristic has a maximum amplitude that is in the range of 10 Oe to 14 Oe.

32. A method according to claim 28, wherein said magnetic field having said AC ringdown characteristic has substantially no DC offset.

33. A method according to claim 27, wherein said processing step includes applying to said substantially saturated bias element a DC magnetic field pulse, said pulse having a polarity that is opposed to a polarity of magnetization of said substantially saturated bias element.

34. A method according to claim 33, wherein said bias element has a coercivity $H_c$, said pulse having a maximum amplitude that is substantially less than $H_c$.

35. A method according to claim 34, wherein said maximum amplitude of said pulse is in the range of 30% to 85% of $H_c$.

36. A method according to claim 27, wherein said processing step includes heating said substantially saturated bias element to a temperature below a Curie temperature of said bias element.

37. A method according to claim 27, wherein said processing step includes applying mechanical stress to said substantially saturated bias element.

38. A method according to claim 27, further comprising the step of transporting said bias element from a first location at which said applying step occurs to a second location at which said processing step occurs.

39. A method of placing a magnetomechanical EAS marker in an activated condition, the marker including an amorphous magnetostrictive element and a semi-hard bias element mounted adjacent said magnetostrictive element, the bias element having a length extent, the method comprising the steps of:

applying a magnetic field to said bias element to magnetize said bias element substantially to saturation; and processing said substantially saturated bias element to redistribute a locus of magnetic charge in said element, said processed bias element retaining a substantial remanent magnetization along its length extent.

40. A method according to claim 39, wherein said processing step includes applying to said saturated bias element a magnetic field having an AC ringdown characteristic.

41. A method according to claim 39, wherein said processing step includes heating said substantially saturated bias element to a temperature below a Curie temperature of said bias element.

42. A method according to claim 39, wherein said processing step includes applying mechanical stress to said substantially saturated bias element.

43. A method according to claim 39, wherein said processing step includes applying to said substantially saturated bias element a DC magnetic field pulse, said pulse having a polarity that is opposed to a polarity of magnetization of said substantially saturated bias element.

44. A method according to claim 39, further comprising the step of transporting said bias element from a first location at which said applying step occurs to a second location at which said processing step occurs.

45. A magnetomechanical EAS marker comprising an amorphous magnetostrictive element and a semi-hard bias element mounted adjacent said magnetostrictive element, said bias element having a length extent and having been magnetized substantially to saturation and then processed to redistribute a locus of magnetic charge in said element, said bias element retaining a substantial remanent magnetization along its length extent.

46. A magnetomechanical EAS marker according to claim 45, wherein said locus of magnetic charge in said bias element was redistributed by applying to the bias element a magnetic field having an AC ringdown characteristic.

47. A magnetomechanical EAS marker according to claim 45, wherein said locus of magnetic charge in said bias element was redistributed by applying to the bias element a DC magnetic field pulse, said pulse having a polarity opposed to a polarity of magnetization of said bias element.

48. A magnetomechanical EAS marker according to claim 45, wherein said locus of magnetic charge in said bias element was redistributed by heating the bias element to a temperature below a Curie temperature of the bias element.

49. A magnetomechanical EAS marker according to claim 45, wherein said locus of magnetic charge in said bias element was redistributed by applying mechanical stress to the bias element.

50. A bias element for use in a magnetomechanical EAS marker, said bias element having a length extent and having been magnetized substantially to saturation and then processed to redistribute a locus of magnetic charge in said element, said bias element retaining a substantial remanent magnetization along its length extent.

51. A bias element according to claim 50, wherein said locus of magnetic charge in said bias element was redistributed by applying to the bias element a magnetic field having an AC ringdown characteristic.

52. A bias element according to claim 50, wherein said locus of magnetic charge in said bias element was redistributed by applying to the bias element a DC magnetic field pulse, said pulse having a polarity opposed to a polarity of magnetization of said bias element.

53. A bias element according to claim 50, wherein said locus of magnetic charge in said bias element was redistributed by heating the bias element to a temperature below a Curie temperature of the bias element.

54. A bias element according to claim 50, wherein said locus of magnetic charge in said bias element was redistributed by applying mechanical stress to the bias element.

* * * * *